US010718514B1

(12) United States Patent
Yu

(10) Patent No.: US 10,718,514 B1
(45) Date of Patent: Jul. 21, 2020

(54) GARBAGE INCINERATION DEVICE FOR GARBAGE DISPOSAL

(71) Applicant: Hangzhou Jianyi Technology Co., Ltd., Hangzhou, Zhejiang (CN)

(72) Inventor: Chengpeng Yu, Zhejiang (CN)

(73) Assignee: Hangzhou Jianyi Technology Co., Ltd., Hangzhou (CN)

( * ) Notice: Subject to any disclaimer, the term of this patent is extended or adjusted under 35 U.S.C. 154(b) by 0 days.

(21) Appl. No.: 16/706,651

(22) Filed: Dec. 6, 2019

(51) Int. Cl.
*F23G 5/44* (2006.01)
*B03B 9/06* (2006.01)

(52) U.S. Cl.
CPC ..... *F23G 5/444* (2013.01); *B03B 9/06* (2013.01); *F23G 2201/70* (2013.01); *F23G 2201/80* (2013.01); *F23G 2205/121* (2013.01); *F23K 2201/10* (2013.01); *F23K 2201/50* (2013.01); *F23K 2203/202* (2013.01)

(58) Field of Classification Search
CPC ..... F23G 5/444; F23G 2201/70; F23G 2205/121; F23G 2201/80; F23K 2203/202; F23K 2201/10; F23K 2201/50
See application file for complete search history.

(56) References Cited

U.S. PATENT DOCUMENTS 3,357,377 A * 12/1967 Stevens ..... F23G 5/16 110/190
3,584,587 A * 6/1971 Siracusa ..... F23G 5/444 110/222
3,682,117 A * 8/1972 Rousseau ..... F23G 5/22 110/216
3,719,171 A * 3/1973 Brooks ..... B03B 9/06 122/2
4,180,004 A * 12/1979 Johnson ..... B02C 18/0084 110/222
5,233,932 A * 8/1993 Robertson ..... F23G 5/033 110/101 R
5,277,136 A * 1/1994 Davis ..... A61L 11/00 110/347
5,680,821 A * 10/1997 Wright ..... F23G 5/444 110/110

(Continued)

FOREIGN PATENT DOCUMENTS

CN 204987036 U 1/2016
CN 108057480 A 5/2018

(Continued)

*Primary Examiner* — David J Laux
(74) *Attorney, Agent, or Firm* — Wayne & Ken, LLC; Tony Hom

(57) ABSTRACT

The present disclosure discloses a garbage incineration device for garbage disposal, relating to the technical field of garbage disposal, in particular to a stirring device, a conveying device and a combustion device. The bottom portion of one side of the stirring device is fixedly mounted with a conveying device, and one of the tops of the conveying device The side is fixedly equipped with a combustion device, the stirring device comprises a mixer, and a storage box is fixedly installed in a middle portion of the top portion of the mixer, and a drainage pipe is fixedly mounted on one side of the bottom portion of the storage box, and a funnel is fixedly mounted on one side of the bottom portion of the mixer. The garbage incineration device for garbage disposal can make the garbage burn more fully when incinerated.

8 Claims, 3 Drawing Sheets

(56) References Cited

U.S. PATENT DOCUMENTS

| | | | | |
|---|---|---|---|---|
| 5,730,072 | A * | 3/1998 | Wright | F23G 5/006 110/213 |
| 6,270,027 | B1 * | 8/2001 | Premo | B02C 1/005 241/264 |
| 6,311,904 | B1 * | 11/2001 | Leturmy | B02C 19/0081 241/18 |
| 8,328,993 | B2 * | 12/2012 | Feerer | C10B 47/44 202/118 |

FOREIGN PATENT DOCUMENTS

| | | | |
|---|---|---|---|
| CN | 208003840 | U | 10/2018 |
| CN | 108980844 | A | 12/2018 |

* cited by examiner

GARBAGE INCINERATION DEVICE FOR GARBAGE DISPOSAL

CROSS-REFERENCE TO RELATED APPLICATIONS

This application claims the benefit of priority from Chinese Patent Application No. 201811627329.5, filed on Dec. 28, 2018. The content of the aforementioned application, including any intervening amendments thereto, is incorporated herein by reference in its entirety.

TECHNICAL FIELD

The present disclosure relates to the technical field of garbage disposal, in particular to a garbage incineration device for garbage disposal.

BACKGROUND

Garbage burial and garbage incineration have become the main methods of municipal garbage disposal. Garbage burial is likely to pollute the soil and cause soil to indirectly pollute the groundwater. Therefore, garbage incineration is mostly adopted for garbage disposal presently, and the garbage incineration device combines high-temperature thermal decomposition and melting treatment, which is convenient for burial, saves land, and eliminates various pathogens. Modern garbage incinerators are equipped with good soot purification devices to prevent air pollution.

Garbage incineration is the best treatment method for non-recyclable garbage. The existing garbage incineration device does not burn the garbage completely, and it is impossible to completely burn some metal debris. If the metal that is not completely burned is polluting, it can cause twice pollution to the environment. Also, the existing garbage incineration device cannot be automatically cleaned, and long-term incineration is likely to cause blockage. In addition, cleaning of the existing garbage incineration device generates dust, which affects the environmental protection of the garbage incineration device.

SUMMARY

In view of the deficiencies of the prior art, the present disclosure provides a garbage incineration device for garbage disposal that solves the problems raised in the above background art.

To achieve the above object, the present disclosure is achieved by the following technical solutions: a garbage incineration device for garbage disposal, comprising: a stirring device, a conveying device and a combustion device, the conveying device being fixedly mounted at a bottom portion of one side of the stirring device, and the combustion device being fixedly mounted at one side of atop portion of the conveying device;

wherein the stirring device comprises a mixer, and a middle portion of a top end of the mixer is fixedly mounted with a storage tank, a drainage pipe is fixedly mounted on one side of the bottom portion of the storage box, and a funnel is fixedly mounted on one side of a bottom portion of the mixer;

the conveying device comprises a conveying pipe fixedly mounted on a bottom portion of one side of the stirring device, a middle portion of an inner cavity of the conveying pipe is movably sleeved with a screw conveyer, one side of a top end the conveying pipe is fixedly mounted with a support frame, one side of a top portion of the support frame is fixedly sleeved with a first motor, and a bottom end of an output shaft of the first motor is fixedly connected with a top end of the dragon;

The combustion device comprises a combustion chamber fixedly mounted on one side of atop portion of the conveying device, atop portion of an inner cavity of the combustion chamber is fixedly sleeved with a cleaning device, a bottom portion of the inner cavity of the combustion chamber is fixedly provided with a pulverizing device, one side of a bottom portion of the combustion chamber is fixedly mounted with a fixing plate, one side of a top end of the fixing plate is fixedly mounted with a second motor, a first transmission shaft is fixedly mounted on a bottom portion of one side of the combustion chamber at the fixing plate, a water spray pipe is fixedly sleeved on a bottom portion of an inner cavity of the combustion chamber at the pulverizing device, a middle portion of a bottom end of the combustion chamber is movably sleeved with a stirring rod, and one side of a bottom end of the combustion chamber is fixedly mounted with a second transmission shaft;

The cleaning device comprises a first fixing frame fixedly mounted on atop portion of an inner cavity of the combustion chamber, a middle portion of the top end of the first fixing frame is fixedly mounted with a guide shaft, and an outer side of a top portion of the guide shaft is movably sleeved with a sleeve, atop portion of an inner cavity of the sleeve is provided with a spring, and a top end of the inner cavity of the sleeve is connected with a top end of the guide shaft in a transmission way by the spring;

The pulverizing device comprises a fixing ring is fixedly sleeved at a bottom portion of an inner cavity of the combustion chamber, a middle portion of an inner cavity of the fixing ring is fixedly sleeved with a second fixing frame, and a top end and a bottom end of a central inner cavity of the second fixing frame are respectively movably sleeved with a rotating shaft, one end of each of the two rotating shafts is fixedly sleeved with a cutter head, and one side of the second fixing frame is movably sleeved with a drive shaft.

Optionally, one side of a bottom portion of the drainage pipe extends to an inner cavity on one side of a top portion of the mixer, and the drainage pipe is made of stainless steel.

Optionally, a top portion of one side of the second transmission shaft is engaged with one side of a bottom portion of the stirring rod, and atop portion of another side of the second transmission shaft is engaged with one side of a bottom portion of the first transmission shaft.

Optionally, a top end of the first transmission shaft penetrates one side of a top portion of the fixing plate and is engaged with a bottom portion of an output shaft of the second motor, and an outer side of atop portion of the first transmission shaft is movably sleeved with one side of the fixing plate.

Optionally, one side of the drive shaft penetrates one side of a bottom portion of the combustion chamber and is engaged with a top portion of an output shaft of the second motor, and another side of the drive shaft is respectively engaged with one end of each of the two rotating shafts.

Optionally, an outer side of a load-bearing web is in contact with atop portion of an inner cavity of the combustion chamber, and a diameter of the load-bearing web is equal to that of the first fixing frame.

Optionally, a bottom portion of an inner side of the water spray pipe is equidistantly provided with drainage holes, and one side of the water spray pipe penetrates another side of a bottom portion of the combustion chamber.

Optionally, a middle portion of a top end of the combustion chamber is fixedly mounted with an exhaust gas filtering device.

The present disclosure provides a garbage incineration device for garbage disposal, which has the following beneficial effects:

1. The garbage incineration device for garbage disposal can uniformly mix the garbage and the combustion-supporting agent inside the storage box through the mixer, so that the garbage can be burned more fully during incineration, and the combustion-supporting agent can be effectively mixed through the garbage, which can effectively avoid When metal debris is mixed in the garbage, the metal debris cannot be completely burned, and the garbage and the combustion improver can be uniformly mixed by the rotation of the mixer, thereby solving the problem that the existing garbage incineration device does not completely burn the garbage.

2. The garbage incineration device for garbage disposal conveys the mixed garbage to the top portion of the cleaning device through the conveying device for burning, so that the garbage at the top portion of the cleaning device can be lowered and rotated when the garbage reaches a certain weight, and the cleaning can be performed. After the ash of the top portion of the device is shaken, the ash cleaning device can be reset when the weight of the top portion of the ash cleaning device is lowered, so that the ash cleaning device can immediately clean the ash after the garbage incineration, thereby solving the problem that the existing garbage incineration device cannot be automatically The situation of cleaning up.

3. The garbage incineration device for garbage disposal can pulverize the burnt ash by the pulverizing device, so that the ash falls into the bottom portion of the combustion chamber, and the spray pipe can spray the ash, and then the stirring rod can be When the ash and water are stirred, the garbage incineration device can generate dust during the cleaning, which effectively improves the environmental protection of the garbage incineration device, and solves the problem that the existing garbage incineration device generates dust after cleaning.

Figure 1:
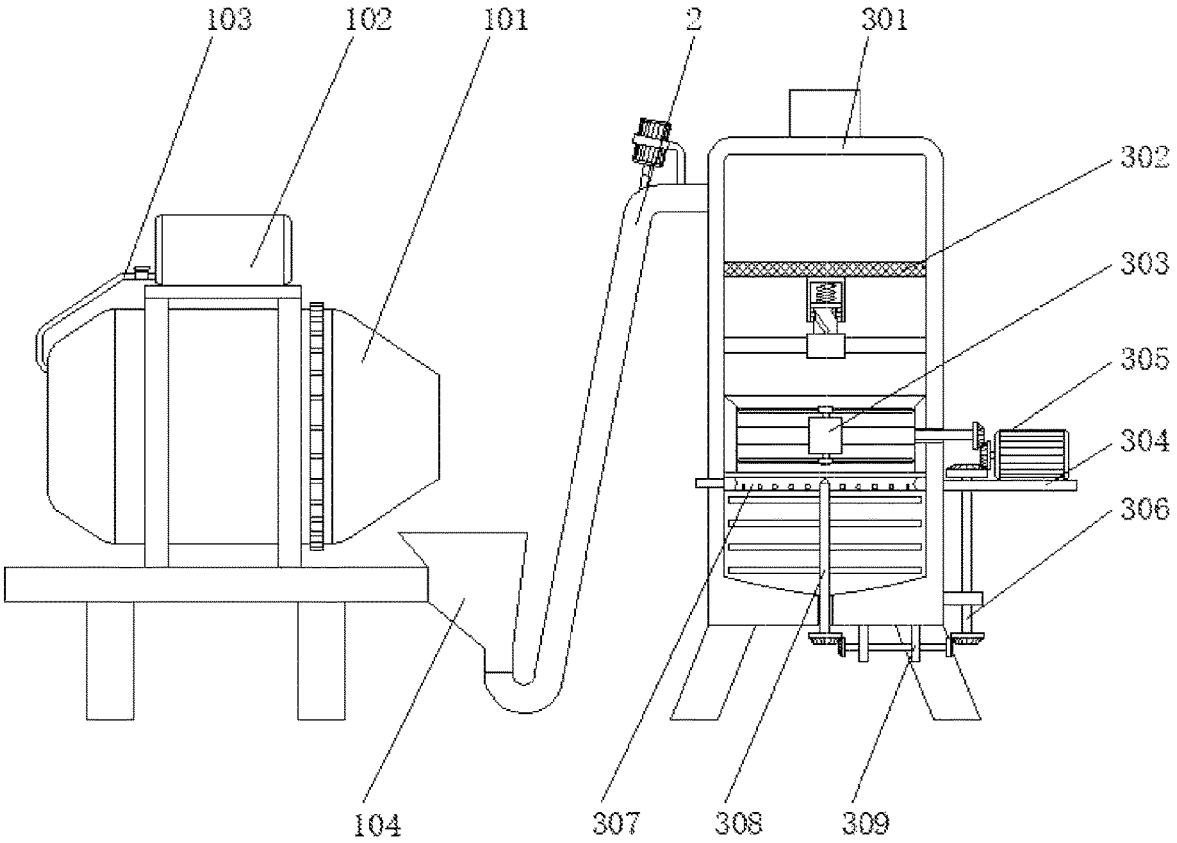
FIG. 1 is a front view of the present disclosure.

In the drawings: 1, stirring device; 101, mixer; 102, storage box; 103, drainage pipe; 104, funnel; 2, conveying device; 201, conveying pipe; 202, screw conveyer; 203, support frame; 204, first motor; 3, combustion device; 301, combustion chamber; 302, cleaning device; 3021, first fixing frame; 3022, guiding shaft; 3023, sleeve; 3024, spring; 3025, load-bearing web; 303, pulverizing device; 3031, fixing ring; 3032, second fixing frame; 3033, rotating shaft; 3034, cutter head; 3035, transmission shaft; 304, fixing plate; 305, second motor; 306, first transmission shaft; 307, water spray pipe; 308, stirring rod; 309, second transmission shaft.

DETAILED DESCRIPTION OF EMBODIMENTS

Figure 2:
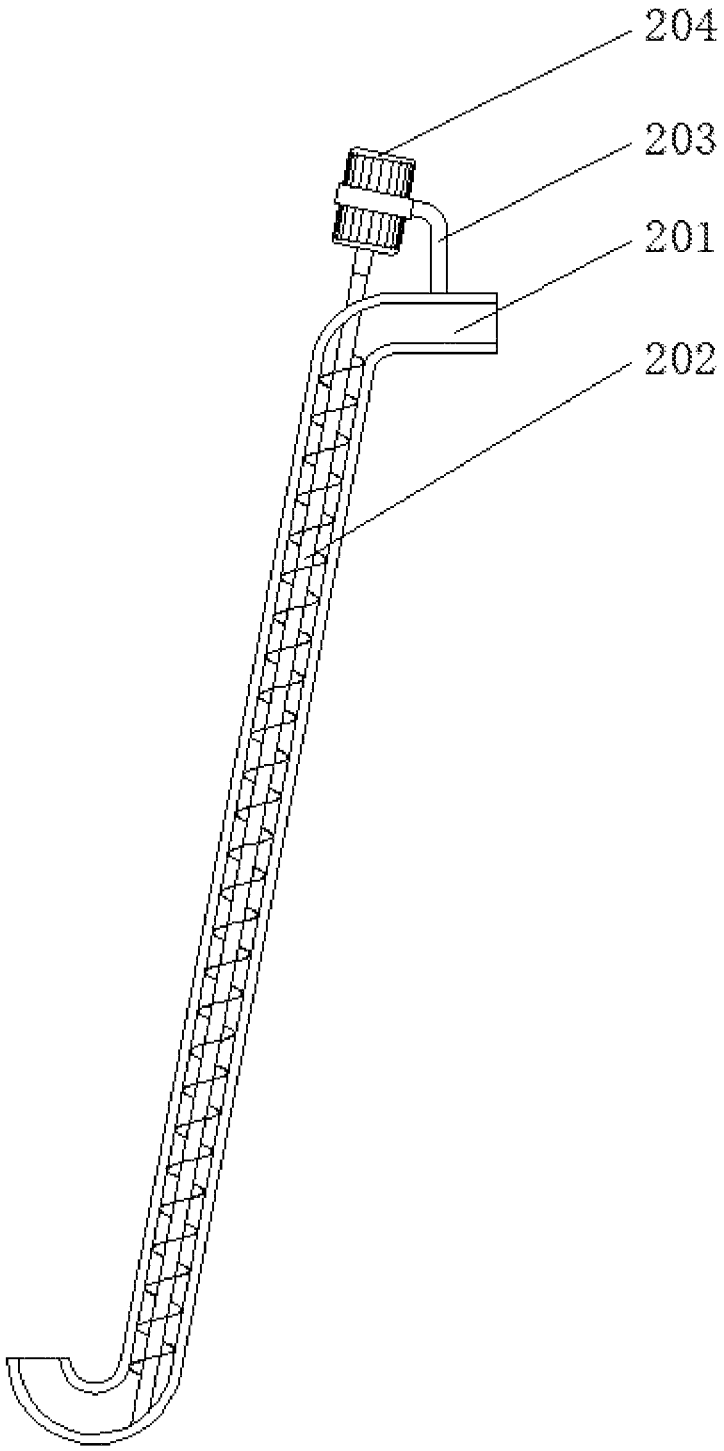
FIG. 2 is a sectional enlarged view of the conveying device of the present disclosure.
Figure 3:
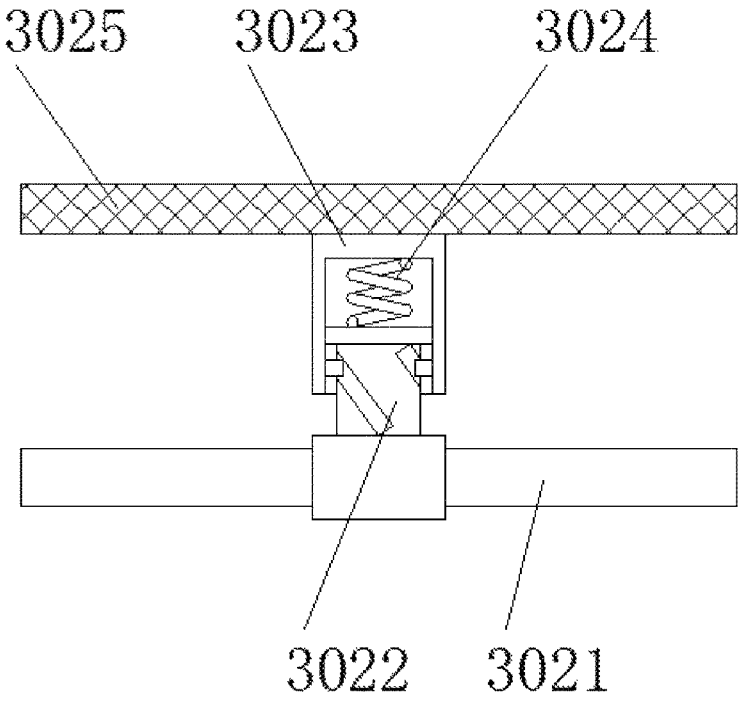
FIG. 3 is an enlarged view of the cleaning device of the present disclosure.
Figure 4:
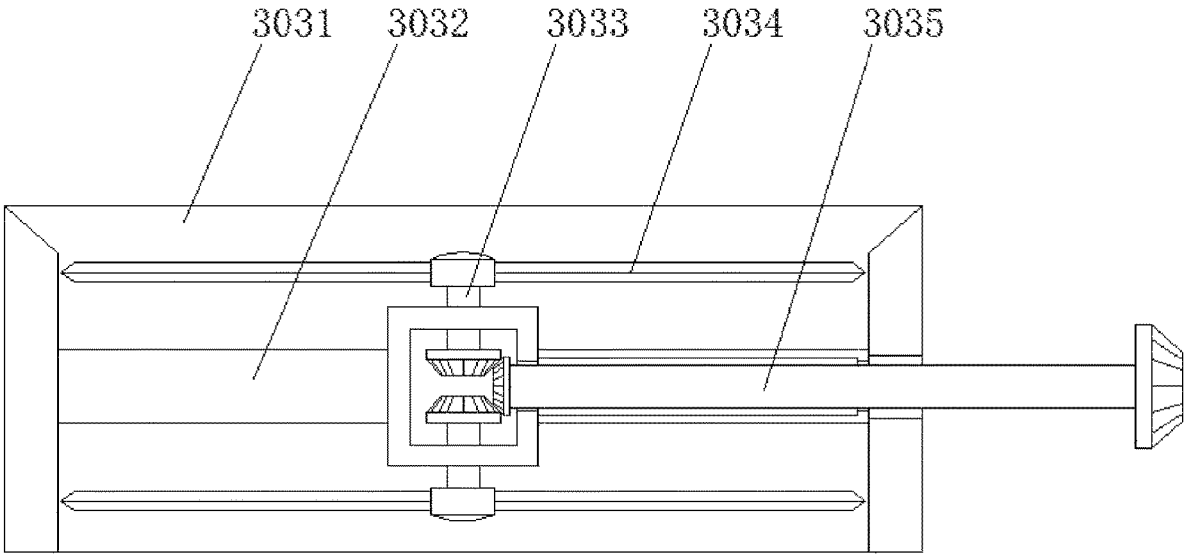
FIG. 4 is a sectional enlarged view of the pulverizing device of the present disclosure.

Embodiments of the drawings of the present disclosure will now be described:

Referring to FIG. 1 to FIG. 4, the present disclosure provides a technical solution: a garbage incineration device for garbage disposal, comprising a stirring device 1, a conveying device 2 and a combustion device 3, the conveying device 2 being fixedly mounted at a bottom portion of one side of the stirring device 1, and the combustion device 3 being fixedly mounted at one side of atop portion of the conveying device 2.

The stirring device 1 comprises a mixer 101, and a middle portion of a top end of the mixer 101 is fixedly mounted with a storage tank 102, a drainage pipe 103 is fixedly mounted on one side of the bottom portion of the storage box 102, and a funnel 104 is fixedly mounted on one side of a bottom portion of the mixer 101. The stirring device 1 can evenly mix the garbage and the combustion improver, thereby effectively improving the thoroughness of the incineration of the garbage incineration device.

The conveying device 2 comprises a conveying pipe 201 fixedly mounted on a bottom portion of one side of the stirring device 1, a middle portion of an inner cavity of the conveying pipe 201 is movably sleeved with a screw conveyer 202, one side of a top end the conveying pipe 201 is fixedly mounted with a support frame 203, one side of a top portion of the support frame 203 is fixedly sleeved with a first motor 204, and a bottom end of an output shaft of the first motor 204 is fixedly connected with a top end of the dragon 202. The conveying device 2 can convey the mixed garbage to the combustion chamber of the combustion device 3, thereby effectively improving the convenience of garbage transportation.

The combustion device 3 comprises a combustion chamber 301 fixedly mounted on one side of atop portion of the conveying device 2, atop portion of an inner cavity of the combustion chamber 301 is fixedly sleeved with a cleaning device 302, a bottom portion of the inner cavity of the combustion chamber 301 is fixedly provided with a pulverizing device 303, one side of a bottom portion of the combustion chamber 301 is fixedly mounted with a fixing plate 304, one side of a top end of the fixing plate 304 is fixedly mounted with a second motor 305, a first transmission shaft 306 is fixedly mounted on a bottom portion of one side of the combustion chamber 301 at the fixing plate 304, a water spray pipe 307 is fixedly sleeved on a bottom portion of an inner cavity of the combustion chamber 301 at the pulverizing device 303, a middle portion of a bottom end of the combustion chamber 301 is movably sleeved with a stirring rod 308, and one side of a bottom end of the combustion chamber 301 is fixedly mounted with a second transmission shaft 309.

The cleaning device 302 comprises a first fixing frame 3021 fixedly mounted on atop portion of an inner cavity of the combustion chamber 301, a middle portion of the top end of the first fixing frame 3021 is fixedly mounted with a guide shaft 3022, and an outer side of a top portion of the guide shaft 3022 is movably sleeved with a sleeve 3023, atop portion of an inner cavity of the sleeve 3023 is provided with a spring 3024, and a top end of the inner cavity of the sleeve 3023 is connected with a top end of the guide shaft 3022 in a transmission way by the spring 3024. The cleaning device 302 can automatically remove the ashes generated by burning of the garbage, thereby effectively preventing the clogging of the garbage incineration device.

The pulverizing device 303 comprises a fixing ring 3031 is fixedly sleeved at a bottom portion of an inner cavity of the combustion chamber 301, a middle portion of an inner cavity of the fixing ring 3031 is fixedly sleeved with a second fixing frame 3032, and a top end and a bottom end of a central inner cavity of the second fixing frame 3032 are respectively movably sleeved with a rotating shaft 3033, one end of each of the two rotating shafts 3033 is fixedly sleeved with a cutter head 3034, and one side of the second fixing frame 3032 is movably sleeved with a drive shaft 3035. The pulverizing device 303 can be used for pulverization of the falling ashes from the top the cleaning device 302, thereby effectively improving the space utilization rate of the garbage incineration device. One side of a bottom portion of the drainage pipe 103 extends to an inner cavity on one side of a top portion of the mixer 101, and the drainage pipe 103 is made of stainless steel. Atop portion of one side of the second transmission shaft 309 is engaged with one side of a bottom portion of the stirring rod 308, and atop portion of another side of the second transmission shaft 309 is engaged with one side of a bottom portion of the first transmission shaft 306. A top end of the first transmission shaft 306 penetrates one side of a top portion of the fixing plate 304 and is engaged with a bottom portion of an output shaft of the second motor 305, and an outer side of atop portion of the first transmission shaft 306 is movably sleeved with one side of the fixing plate 304. One side of the drive shaft 3035 penetrates one side of a bottom portion of the combustion chamber 301 and is engaged with a top portion of an output shaft of the second motor 305, and another side of the drive shaft 3035 is respectively engaged with one end of each of the two rotating shafts 3033. An outer side of a load-bearing web 3025 is in contact with atop portion of an inner cavity of the combustion chamber 301, and a diameter of the load-bearing web 3025 is equal to that of the first fixing frame 3021. A bottom portion of an inner side of the water spray pipe 307 is equidistantly provided with drainage holes, and one side of the water spray pipe 307 penetrates another side of a bottom portion of the combustion chamber 301. A middle portion of a top end of the combustion chamber 301 is fixedly mounted with an exhaust gas filtering device.

In summary, when the garbage incineration device for garbage disposal is used, firstly an appropriate amount of garbage is added into the inside of the mixer 101 and the valve on the drainage pipe 103 is switched on. Then the mixer 101 is started to mix the garbage in the mixer 101 and the combustion improver discharged into the inside of the mixer 101 from the drainage pipe 103. When the garbage and the combustion improver in the mixer 101 are sufficiently mixed, the mixer 101 is operated to be turned over, and the mixed garbage is discharged into the funnel 104. Then the first motor 204 and the second motor 305 are activated and the water spray pipe 307 is connected to the water source, so that the first motor 204 drives the screw conveyer 202 to rotate, and the mixed garbage is transported along the conveying pipe 201 to the top portion of the cleaning device 302. Sequentially, the combustion device 3 is ignited to make the mixed garbage to burn at the top end of the load-bearing web 3025. When the garbage at the top portion of the load-bearing web 3025 reaches a certain weight, the spring 3024 is compressed by the sleeve 3023, so that the sleeve 3023 is lowered along the track outside the guide shaft 3022 and rotated and the ash generated at the top end of the load-bearing web 3025 is poured. When the ash falls through the middle portion of the pulverizing device 303, the second motor 305 drives the two cutter heads 3034 by the driving shaft 3035 to rotate at a high speed in the opposite directions to pulverize the ash. When the pulverized ash falls into the bottom portion of the inner cavity of the combustion chamber 301, the water spray pipe 307 sprays water towards the ash. The second motor 305 drives the stirring rod 308 by the first transmission shaft 306 and the second transmission shaft 309 to mix the ash and the water, and the mixed mortar is discharged through the discharge opening opened at the bottom portion of the back of the combustion chamber 301.

What is claimed is:

1. A garbage incineration device for garbage disposal, comprising: a stirring device (1), a conveying device (2) and a combustion device (3), the conveying device (2) being fixedly mounted at a bottom portion of one side of the stirring device (1), and the combustion device (3) being fixedly mounted at one side of a top portion of the conveying device (2); wherein the stirring device (1) comprises a mixer (101), and a middle portion of a top end of the mixer (101) is fixedly mounted with a storage tank (102), a drainage pipe (103) is fixedly mounted on one side of the bottom portion of the storage tank (102), and a funnel (104) is fixedly mounted on one side of a bottom portion of the mixer (101); the conveying device (2) comprises a conveying pipe (201) fixedly mounted on a bottom portion of one side of the stirring device (1), a middle portion of an inner cavity of the conveying pipe (201) is movably sleeved with a screw conveyer (202), one side of a top end the conveying pipe (201) is fixedly mounted with a support frame (203), one side of a top portion of the support frame (203) is fixedly sleeved with a first motor (204), and a bottom end of an output shaft of the first motor (204) is fixedly connected with a top end of the screw conveyor (202); the combustion device (3) comprises a combustion chamber (301) fixedly mounted on one side of atop portion of the conveying device (2), atop portion of an inner cavity of the combustion chamber (301) is fixedly sleeved with a cleaning device (302), a bottom portion of the inner cavity of the combustion chamber (301) is fixedly provided with a pulverizing device (303), one side of a bottom portion of the combustion chamber (301) is fixedly mounted with a fixing plate (304), one side of a top end of the fixing plate (304) is fixedly mounted with a second motor (305), a first transmission shaft (306) is fixedly mounted on a bottom portion of one side of the combustion chamber (301) at the fixing plate (304), a water spray pipe (307) is fixedly sleeved on a bottom portion of an inner cavity of the combustion chamber (301) at the pulverizing device (303), a middle portion of a bottom end of the combustion chamber (301) is movably sleeved with a stirring rod (308), and one side of a bottom end of the combustion chamber (301) is fixedly mounted with a second transmission shaft (309); the cleaning device (302) comprises a first fixing frame (3021) fixedly mounted on a top portion of an inner cavity of the combustion chamber (301), a middle portion of the top end of the first fixing frame (3021) is fixedly mounted with a guide shaft (3022), and an outer side of a top portion of the guide shaft (3022) is movably sleeved with a sleeve (3023), a top portion of an inner cavity of the sleeve (3023) is provided with a spring (3024), and a top end of the inner cavity of the sleeve (3023) is connected with a top end of the guide shaft (3022) in a transmission way by the spring (3024); the pulverizing device (303) comprises a fixing ring (3031) is fixedly sleeved at a bottom portion of an inner cavity of the combustion chamber (301) a middle portion of an inner cavity of the fixing ring (3031) is fixedly sleeved with a second fixing frame (3032), and a top end and a bottom end of a central inner cavity of the second fixing frame (3032) are respectively movably sleeved with a rotating shaft (3033), one end of each of the two rotating shafts (3033) is fixedly sleeved with a cutter head (3034), and one side of the second fixing frame (3032) is movably sleeved with a drive shaft (3035).

2. A garbage incineration device for garbage disposal according to claim 1, characterized in that one side of a bottom portion of the drainage pipe (103) extends to an inner cavity on one side of a top portion of the mixer (101), and the drainage pipe (103) is made of stainless steel.

3. The garbage incineration device for garbage disposal according to claim 1, characterized in that a top portion of one side of the second transmission shaft (309) is engaged with one side of a bottom portion of the stirring rod (308), and a top portion of another side of the second transmission shaft (309) is engaged with one side of a bottom portion of the first transmission shaft (306).

4. The garbage incineration device for garbage disposal according to claim 1, characterized in that a top end of the first transmission shaft (306) penetrates one side of a top portion of the fixing plate (304) and is engaged with a bottom portion of an output shaft of the second motor (305), and an outer side of a top portion of the first transmission shaft (306) is movably sleeved with one side of the fixing plate (304).

5. The garbage incineration device for garbage disposal according to claim 1, characterized in that one side of the drive shaft (3035) penetrates one side of a bottom portion of the combustion chamber (301) and is engaged with a top portion of an output shaft of the second motor (305), and another side of the drive shaft (3035) is respectively engaged with one end of each of the two rotating shafts (3033).

6. The garbage incineration device for garbage disposal according to claim 1, characterized in that an outer side of a load-bearing web (3025) is in contact with a top portion of an inner cavity of the combustion chamber (301), and a diameter of the load-bearing web (3025) is equal to that of the first fixing frame (3021).

7. The garbage incineration device for garbage disposal according to claim 1, characterized in that a bottom portion of an inner side of the water spray pipe (307) is equidistantly provided with drainage holes, and one side of the water spray pipe (307) penetrates another side of a bottom portion of the combustion chamber (301).

8. The garbage incineration device for garbage disposal according to claim 1, characterized in that a middle portion of a top end of the combustion chamber (301) is fixedly mounted with an exhaust gas filtering device.

* * * * *